United States Patent [19]

Barron, Sr.

[11] 4,060,938

[45] Dec. 6, 1977

[54] GLASS BEVELING MACHINE

[76] Inventor: Lee H. Barron, Sr., 4515 Alta Canyada Road, La Canada, Calif. 91011

[21] Appl. No.: 678,671

[22] Filed: Apr. 20, 1976

[51] Int. Cl.[2] ..... B24B 9/10

[52] U.S. Cl. ..... 51/110; 51/235; 51/240 GB

[58] Field of Search ..... 51/110, 122, 235, 240 GB, 51/283, 77, 112; 269/21

[56] References Cited

U.S. PATENT DOCUMENTS

| | | | |
|---|---|---|---|
| 1,183,947 | 5/1916 | Bradley | 51/110 |
| 1,848,470 | 3/1932 | Fohrenbach | 51/110 |
| 1,908,580 | 5/1933 | Waldron | 51/77 R |
| 2,551,332 | 5/1951 | Moore | 51/110 |
| 2,578,789 | 12/1951 | Donnelly | 51/110 |
| 3,910,621 | 10/1975 | Hillier | 269/21 X |
| 3,922,820 | 12/1975 | Wiltshire | 51/235 X |

FOREIGN PATENT DOCUMENTS

| | | | |
|---|---|---|---|
| 360,126 | 12/1905 | France | 51/122 |
| 48,874 | 10/1909 | France | 51/122 |

*Primary Examiner*—Harold D. Whitehead
*Assistant Examiner*—Nicholas P. Godici
*Attorney, Agent, or Firm*—Hill, Gross, Simpson, Van Santen, Steadman, Chiara & Simpson

[57] ABSTRACT

The glass beveling machine has a table for supporting a piece of glass to be beveled, and glass bevel grinding and polishing means in the form of wheels which may have individual driving heads mounted for adjustment relative to the table for selective angle and depth of bevel. Relative movement of the grinding and polishing means and the table in a glass beveling operation is preferably effected by reciprocating the table. For holding the glass piece in place on the table during the beveling operation retaining curb means and a vacuum plenum are carried by the table. Coolant and polishing solution drain-off is facilitated by tilted mounting of the table toward collection trough means.

17 Claims, 7 Drawing Figures

GLASS BEVELING MACHINE

This invention relates to glass beveling machines in which a bevel is ground and polished on an edge of a glass plate in a single beveling operation pass through the machine.

Beveling the edge of plate glass and mirrors was originally accomplished manually and skill of the workmen was depended upon for the quality of results. In modern times machines for straight glass beveling have been provided according to a basic design very similar regardless of the manufacturer. Such machines feed the glass sheets in a generally vertical position with the grinding wheels and polishing wheel set in a generally vertical position along the bottom edge of the glass sheets. In such machines in order to adjust the angle and width of the bevel requires major readjustment of the back support, for the glass plates. Further, the minimum size of glass piece that may be beveled is limited to on the order of 10 to 12 inches in width. Many machines are incapable of producing bevels on glass plates under 10 inches wide down to 2 inches wide and small 2 inch squares. Prior machines are lacking in capability of producing certain desirable bevel angles, such as 45° and 22½°on glass pieces as small as 2, 3 and 4 inch widths.

An important object of the present invention is to provide a new and improved glass beveling machine which will overcome the disadvantages, deficiences, inefficiencies, shortcomings and problems encountered in prior machines and will attain substantially new and improved results.

Another object of the invention is to provide a new and improved glass beveling machine having novel glass supporting table means.

A further object of the invention is to provide a new and improved glass beveling machine having novel, glass holding means.

Still another object of the invention is to provide new and improved adjustable grinding and polishing means in a glass beveling machine.

According to features of the invention there is provided a glass beveling machine comprising level grinding and polishing means, a table for supporting a glass plate to be beveled in generally face-up position and with an edge of the plate oriented for operation of the grinding and polishing means on the edge, means enabling relative movement of the grinding and polishing means and the table in a beveling pass, and means such as retaining curbs and a perforated vacuum plenum for holding the glass plate in place on the table against displacement during the beveling pass.

In a preferred arrangement the grinding and polishing means comprise respective wheels having driving heads and means for adjusting the beveling attitude of the grinding wheels relative to the glass plate carried by the table for beveling.

In a preferred arrangement the table is mounted for reciprocation relative to the grinding and polishing wheels and is driven cyclically in beveling and return strokes.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which.

Figures 1, 2:
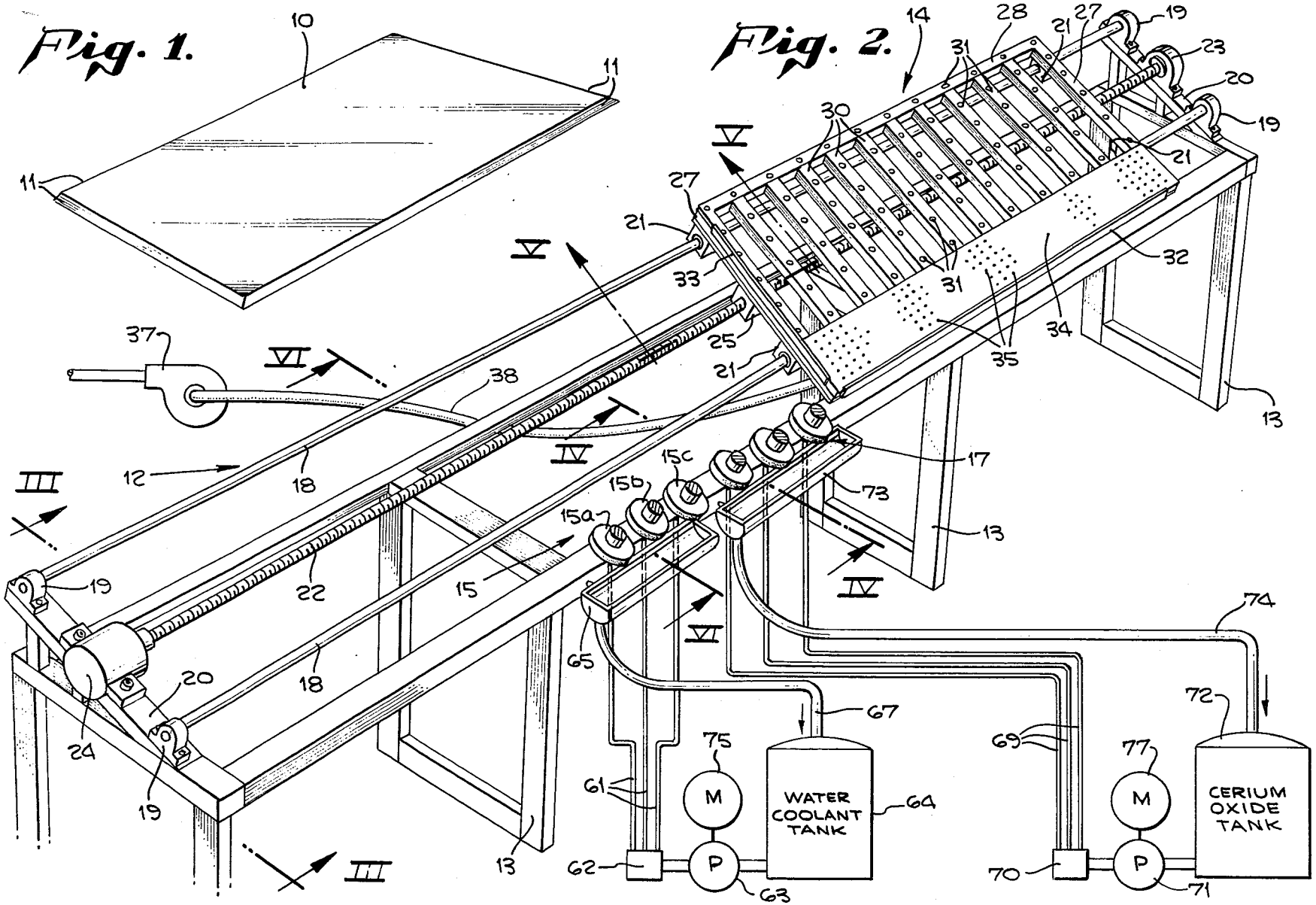
FIG. 1 is representative of a plate glass piece beveled on a machine according to the present invention.
FIG. 2 is a perspective view of a representative glass beveling machine embodying features of the invention with certain parts shown schematically.

Having reference to FIG. 1, a piece of plate glass 10, which may or may not be a mirror, has one or more beveled edges 11, in this instance four such edges, all of which are rectilinear and adapted to be produced on a bevel grinding machine 12 depicted in FIG. 2. This machine comprises a suitable frame 13 on which is carried a reciprocative table 14 for supporting a piece of glass to be beveled by means of an array of grinding wheels 15 and polished by means of one or more polishing wheels 17. In order to handle plate glass pieces on the order of 50 by 72 inches in size, the carriage 14 may be not less than 72 inches long and about 48 inches wide. In order to complete traverse of the table 14 past the grinding wheels 15 and the polishing wheels 17 in each direction, the frame 13 may be on the order of 17 feet long and of sufficient width to provide adequate support for the table.

Reciprocations of the table 14 longitudinally along the top of the frame 13 are guided by suitable track means such as suitably spaced longitudinally extending track rods 18 supported at their opposite ends by means of mounting blocks 19 in this instance mounted on header bars 20 on the opposite ends of the frame 13 and tilted at a suitable angle such as about 30° toward the grinding and polishing wheels 15 and 17 which are mounted to cooperate with the low side of the table 14 in the beveling operation. As nearly as practicable frictionless riding of the table 14 along the track rods 18 is attained by means of rider bearings 21 carried by the underside of the table at its opposite ends. As thus mounted, the table 14 is reciprocated by means of a drive screw 22 adjacently underlying the table 14 and extending substantially the full length of the frame 14. At one end the drive screw 22 is carried rotatably by bearing means 23 mounted on the header bar 20 at that end of the frame. At its opposite end, the drive screw 22 is connected with suitable actuating means such as reversible motor 24 of any preferred type, perferably electrical, but which may be fluid operated such as hydraulic if desired. The motor 24 may be supported, as shown, on the header bar 20 adjacent to the motor end of the screw 22. In a preferred arrangement the drive screw 22 is of the acme thread type (FIG. 5) and is engaged by means of a follower nut 25 suitably mounted on the underside of the table 14.

Figures 3, 4, 5:
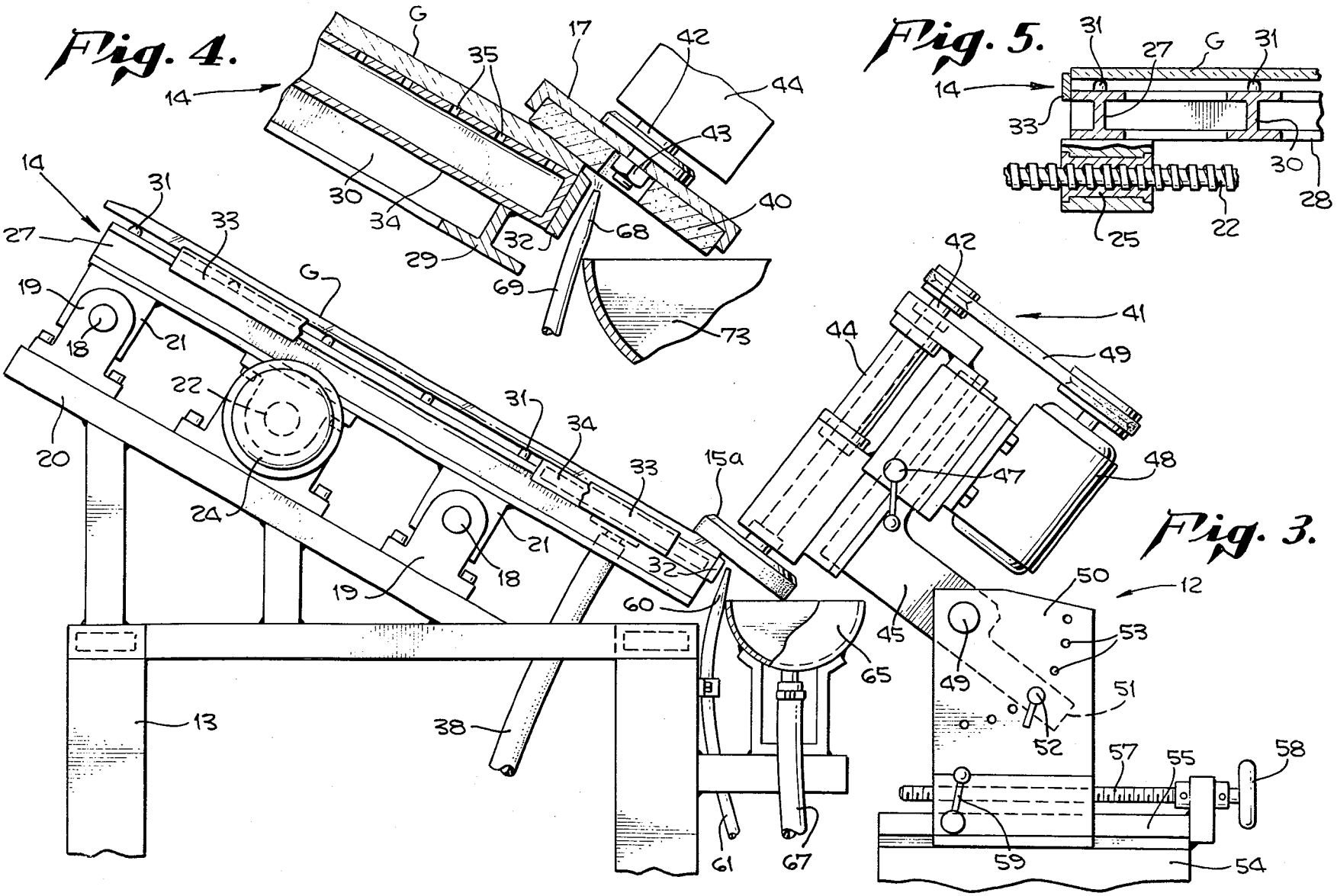
FIG. 3 is an end elevational view taken substantially in the plane of line III—III of FIG. 2.
FIG. 4 is a fragmentary sectional detail view taken substantially along the line IV—IV of FIG. 2, showing one of the polishing wheels in operative relation to a glass piece supported on the table of the machine.
FIG. 5 is an enlarged fragmentary sectional detail view taken substantially along the line V—V of FIG. 2.
Figure 6:
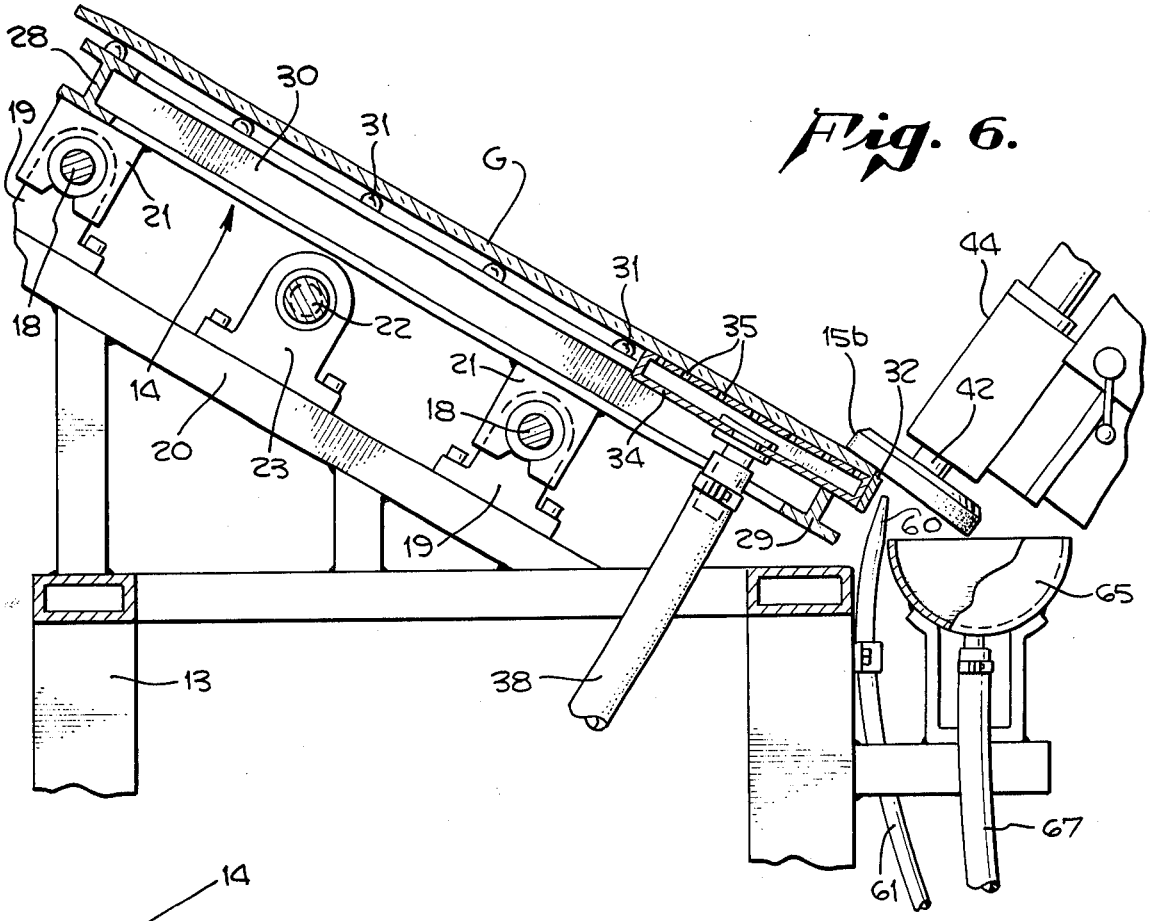
FIG. 6 is a sectional elevational detail view taken substantially along the line VI—VI of FIG. 2.
Figure 7:
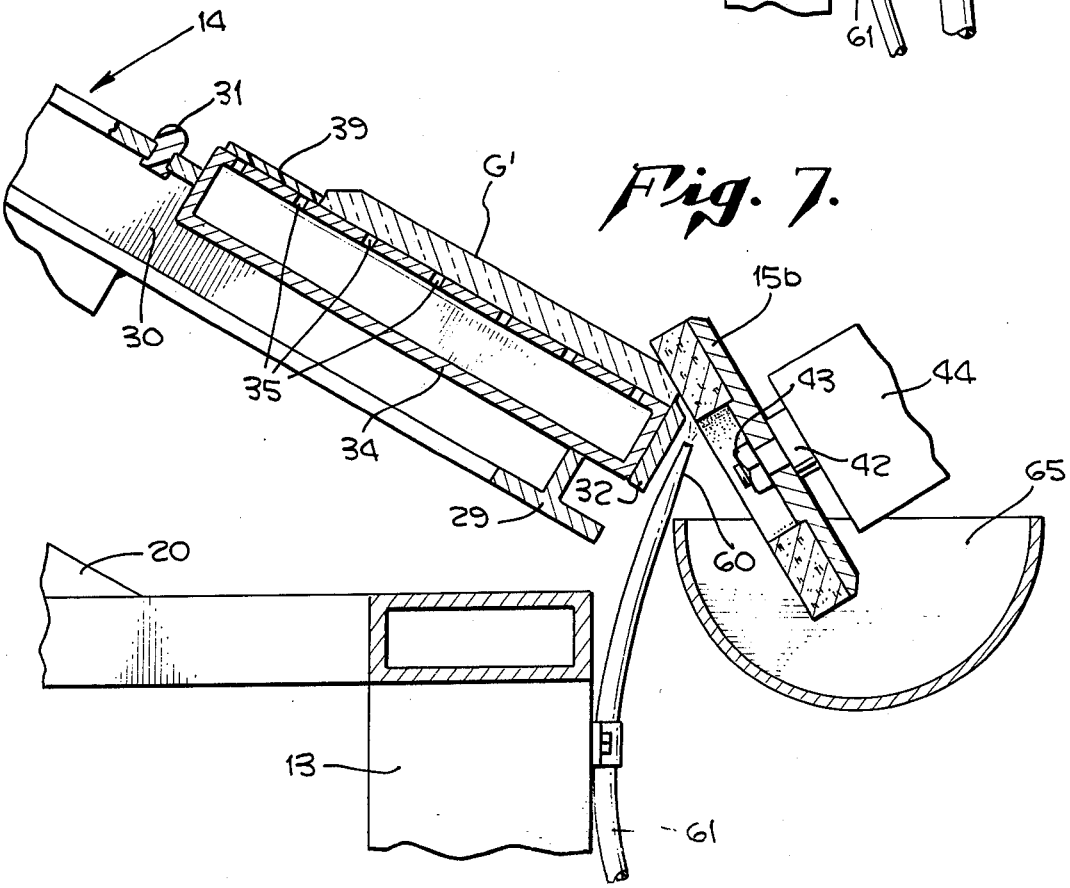
FIG. 7 is a view similar to FIG. 6, but showing the grinding wheel at a different operative beveling angle.

In a desirable lightweight, rugged construction, the table 14 comprises a substantially rectangular frame having similar opposite end bars 27 rigidly connected to a longitudinal rear bar 28. Along their front ends the side bars 27 are rigidly attached to a longitudinal front bar 29 (FIGS. 4, 6 and 7). At spaced intervals between the side bars 27 are spaced parallel slot-like support bars 30 rigidly attached at their opposite ends to respectively the rear bar 28 and the front bar 29 and perferably having their upper surfaces in a common plane with the side bars 27 and the rear bars 28. Cushioned support of a glass plate to be beveled on the carriage 14 in spaced relation on top of the preferably metal table frame bars is desirably effected by means of suitably spaced knobs or buttons 31 formed from suitable plastic and fixed at suitable spaced intervals to the tops of the bars 27, 28 and 30. On their crown ends the buttons 31 are formed with suitable, such as semi-spherical, surfaces all of which lie in a common supporting plane.

Means are provided for holding the glass pieces in place on the table during bevel grinding and polishing, including a gauging retaining curb 32 along the lower longitudinal edge of the table 14 which will hold the edge of the glass piece in proper beveling position for operation thereon of the grinding wheels 15 and the polishing wheels 17. By reason of the forward tilt of the table 14 placement of the glass piece on the table 14 for beveling will automatically result in the glass piece sliding down against the edge stop provided by the curb 32. As a stop against longitudinal displacement of the glass piece during beveling operation, retaining stop curb 33 is carried by the trailing end of the table 14. Additional means for holding the glass piece positively in place on the table and in particular against the curb 32, comprise a perforated vacuum plenum 34 providing the lower portions of the table surface and desirably extending along the entire length of the table 14 contiguous to the curb 32. The plenum 34 is of ample width for efficiently gripping and holding the glass plate being beveled against any tendency of the grinding or polishing wheels to displace the plate laterally away from the curb 32. Where the table 14 is about 48 inches wide, the plenum 34 may be about 14 inches wide. At suitable intervals in the top supporting surface of the plenum 34 suction holes 35 provide suction grip of the superposed glass plate when the plenum chamber is placed under negative pressure as by means of a suitable vacuum source 37 connected with the plenum chamber by means of a suitable flexible conduit 38 and permitting free reciprocating movement of the table 14 relative to the vacuum source. A desirable spacing of the suction ports 35 may be about two inches on center in suitable array over substantially the full area of the top panel of the plenum 34. Through this arrangement glass plate of maximum size as well as any incrementally smaller size down to on the order of 2 inch square can be efficiently handled for beveling by the table 14.

As demonstrated in FIGS. 3 and 6, a large size glass piece G may fully cover the top panel of the plenum 34 and thus in operation of the vacuum source maximum vacuum holddown capability of the plenum is utilized. Where, as demonstrated in FIG. 7, a glass piece G' is to be beveled and which is smaller in either width or length than the plenum 34, those of the vacuum holes 35 which are not covered by the glass plate are suitably covered to avoid vacuum loss as by applying one or more cover or masking strips or panels 39 over the plenum area not occupied by the glass piece. Since the thinnest glass that may usually be beveled is about 3/16 inch, the masking panels 39 may be on the order of ⅛ inch thick. Where a production run of a substantial number of the smaller sized glass pieces G', of whatever dimension, is to be beveled, suitable template-like forms of the masking plate 39 may be cut and suitably temporarily attached over unused area of the perforated plenum face.

For illustrative purposes, the table 14 has been depicted in FIG. 2 as at substantially the runout or end of beveling operation stroke or pass, at which point the table may be stopped for unloading a beveled glass piece. On the other hand the glass piece may be returned in the opposite direction, as indicated by directional arrow, to the starting or loading position where if the piece requires beveling of another edge if may be merely shifted on the table to present another edge for beveling, or if completed may be removed and replaced by another piece to be beveled. As placed on the table 14 the glass piece will have the edge to be beveled in gauged position against the curb 32 which projects above the suction face of the plenum 34 just far enough to hold the glass piece without interferring with the deepest bevel that it may be desired to grind on the glass piece edge. Although the drive screw 22 may be operated by the power means motor 24 for rapid traverse return of the table 14 to the loading position, it is geared or otherwise operable to drive the table 14 in the beveling operation stroke at a preferred rate of speed commensurate with the grinding capacity of the array of grinding wheels 15.

In a preferred arrangement, three of the grinding wheels 15 will satisfactorily successively grind whatever degree and depth of bevel desired. For example, the grinding wheels 15 may be of a type which are capable of removing as much as 0.125 inch of glass at 20 inches per minute. For this purpose, the first wheel 15*a* may be a 140/180 diamond grit coated wheel, the second grinding wheel 15*b* may be a 300/320 diamond grit coated wheel, and the third grinding wheel 15*c* may be a 400 diamond grit impregnated wheel. It will be understood, of course, that each of the wheels 15*a*, 15*b* and 15*c* will be set to grind the bevel successively deeper. After passing beyond the last glass grinding wheel 15*c*, the bevel is polished by the polishing wheels 17 which may also be three in number and each having a felt or suitable polishing face 40 (FIG. 4). Each of the polishing wheels may be suitably set to apply an optimum polishing pressure.

In a preferred arrangement, each of the wheels 15 and 17 may be operatively carried by an individual driving head 41 (FIG. 3) each of which is individually mounted for proper relative adjustment of its wheel relative to the desired bevel plane. Each of the heads 41 includes a rotary spindle shaft 42 having a lower end equipped for replaceable attachment of its associated wheel, as by means of a nut 43 (FIGS. 4 and 7). The shaft 42 is journaled in a suitable carriage 44 mounted on a support 45 in a manner to enable adjustments of the head relative to the support in the longitudinal direction of the shaft 42. In any relative longitudinal adjusted position, the carriage 44 is adapted to be locked by suitable means including an operating handle 47. For this purpose the adjustment enabling and locking structure may be of the well known gib track arrangement. Each of the shafts 42 may be driven by an individual motor 48 suitably coupled drivingly therewith as by means of an endless flexible coupling such as a V-belt 49. Desirably the motor 48 is carried by the same carriage 44 as the shaft 42.

In order to facilitate grinding of numerous selected angles and depths of bevel, means are provided for angular tilting and reciprocative adjustments of the heads 42 through the supports 45. Accordingly, each of the supports 45 comprises a rocker arm structure mounted as by means of a pivot shaft or trunion 49 on means such as a mounting frame block 50. Various bevel angle positions are attained by swinging the head 41 on its support arm 45 about the pivot 49. For locking the head 41 in any preferred adjusted bevel position, means comprising a tail piece 51 on the support 45 is adapted to be locked as by means of a pin key device 52 in the desired bevel position predetermined as by means of a selected one of an arcuate array of bevel setting pin holes 53 in the mounting block 50.

For depth of bevel adjustment of the head 41, the block 50 is carried in horizontally reciprocative in-and-out adjustable position relative to the table 14 on a supporting frame 54 which may be separate from but may also be an adjunct to or projection from the main frame 13. Guide track means 55 connect the mounting block 50 of the frame 54, and substantially micrometer adjustment screw means 57 operated through handle means 58 effect the desired bevel depth adjustment of the block 50 along the track 55. The adjusted position is held by suitable lock means including an operating handle 59. As a result, the several grinding and polishing wheels can be quickly and easily set up and adjusted to obtain optimum beveling results. For example, in FIGS. 3, 4 and 6 the adjustment is shown as attaining a 7° bevel. In FIG. 7 the adjustment attains a 30° bevel.

Coolant solution such as water is applied to the grinding zone of each of the grinding wheels 15 by a respective nozzle 60 (FIGS. 6 and 7) to which coolant water with any desired additive is delivered by means of respective conduits 61 leading from a manifold 62 connected through a pump 63 with a suitable source such as a tank 64. Coolant is recycled by draining off into suitable trough means 65 and is returned by way of a conduit 67 to the tank 64 for recycling.

Suitable polishing solution such as cerium oxide in water is supplied to the polishing zone of each of the polishing wheels 17 as by means of a respective nozzle 68 supplied through a respective duct 69 communicating through a manifold 70 with a pump 71 connected with a suitable source such as a tank 72. The polishing solution is recycled by collection in a drain trough 73 which delivers the spent polishing fluid by way of a conduit 74 to the tank 72.

Drainage into the troughs 65 and 73 is promoted by the tilt of the table 14 toward the wheels 15 and 17.

Operating control of the machine may be effected in any preferred manner such as by conventional electrical circuitry and suitable digital control means by which the several motors 24 and 48, a drive motor 75 for the pump 63 and a drive motor 77 for the pump 71 are controlled.

It will be understood that variations and modifications may be effected without departing from the spirit and scope of the novel concepts of this invention.

I claim as my invention:

1. A glass beveling machine, comprising bevel grinding and polishing means; a table for supporting a glass plate to be beveled in generally face-up position and with an edge of the plate oriented for operation of said grinding and polishing means on said edge;

means enabling relative movement of the grinding and polishing means and the table in a beveling pass comprising table guiding structure and means for reciprocatingly driving the table along said guiding structure;

said table comprising an array of supporting bars in a slat-like spaced relation;

limited contact glass plate supporting button-like members in spaced relation on said bars;

and means located along an edge of the table nearest said bevel grinding and polishing means for holding the glass plate on the table against displacement during the beveling pass.

2. A machine according to claim 1, wherein said table supports the glass plate in a sloping relation toward said edge, said bevel grinding and polishing means comprising grinding wheels and polishing wheels, means supplying coolant to said grinding wheels and polishing solution to said polishing wheels, and separate drain means below said wheels for separately receiving spent coolant and polishing solution.

3. A machine according to claim 1, wherein said guiding structure comprise a plurality of spaced track rods and said table has rider bearings at its opposite ends slidably engaging said track rods, said driving means comprising a rotary drive screw parallel to and located in spaced relation between said track rods, said screw being engaged by follower means on the table, and powered driving means at one end of the screw for operating the screw rotatively to effect traverse of the table relative to said grinding and polishing means.

4. A machine according to claim 1, wherein said holding means comprise a vacuum plenum having a supporting surface in a plane with supporting tops of said button-like members, an array of small suction holes through said supporting surface into said plenum, and means for creating a vacuum in said plenum whereby to effect glass plate retaining suction at said holes.

5. A machine according to claim 4, including a glass plate edge retaining curb along said edge of the table adjacent to the plenum, said curb extending above said plenum supporting surface to a height less than the thickness of the glass plate.

6. A machine according to claim 5, wherein said table is disposed in a sloping relation toward said bevel grinding and polishing means whereby orientation of the glass plate is normally gravitationally toward said curb, and an additional glass plate edge retaining curb extending along one end of the table normal to said curb which is located along said edge of the table, said end curb serving to resist displacement of the plate lengthwise of the table during grinding and polishing.

7. A machine according to claim 1, wherein said button-like members are formed from plastic and have semi-spherical surfaces.

8. A machine according to claim 1, wherein said bevel grinding and polishing means comprise respective wheels, means for rotatively driving said wheels, carriages supporting said wheel driving means, and means for adjusting said carriages relative to said table in a generally up and down relation to the table as well as in an angular bevel adjusting relation relative to the table and also in a front to rear direction relative to the table.

9. A machine according to claim 1, wherein said grinding and polishing means comprise a first 140/180 diamond grit coated grinding wheel, a second 300/320 diamond grit coated grinding wheel and a third 400 diamond grit impregnated grinding wheel operative in that order to grind the bevel on the glass plate edge, and a plurality of polishing wheels operative successively on the finally ground bevel.

10. A glass beveling machine, comprising:

bevel grinding and polishing means;

a table for supporting a glass plate to be beveled in generally face-up position and with an edge of the plate oriented for operation of said grinding and polishing means on said edge;

means enabling relative movement of the grinding and polishing means and the table in a beveling pass;

means for holding the glass plate on the table against displacement during the beveling pass;

said grinding and polishing means comprising respective wheels;

shafts carrying said wheels rotatably;

independent means for driving each of said shafts rotatably;

respective separate carriages carrying said shafts and said driving means independently;

rocker structure to which the carriages are attached;

means supporting said rocker structure;

means for adjusting the carriages in a generally up and down relation relative to said rocker structure;

means for adjusting the rocker structure tiltably relative to said rocker structure supporting means;

means for adjusting the position of said rocker structure supporting means in a generally horizontal direction toward and away from said table and said plate edge;

said table sloping toward said grinding and polishing wheels;

a vacuum plenum on the table adjacent to its lower edge and having a perforated surface supporting the lower edge portion of the glass plate in position for grinding and polishing by said wheels;

and gauging curb means along said plenum projecting to a height above said plenum surface less than the thickness of the glass plate for gauging the position of the plate along the edge of the table for grinding and polishing of a bevel by means of said wheels.

11. A machine according to claim 10, wherein the table includes glass supporting means upwardly thereon relative to said plenum and comprising an array of button-like limited glass contact members having their tops in a plane with said plenum surface.

12. A machine according to claim 11, wherein said table comprises an array of supporting bars in a slat-like spaced relation, said bars carrying said button-like members.

13. A glass beveling machine, comprising:

an elongate supporting frame;

a table shorter than said frame and adapted for supporting a glass plate to be beveled in generally face-up position for grinding and polishing of a bevel on an edge of the glass plate;

a pair of parallel spaced coextensive slide track rods extending throughout substantially the length of said frame;

means on top of said frame supporting said track rods in an oblique plane sloping toward one longitudinal edge of the frame;

slide bearings at each opposite end of said table slidably engaging said track rods and supporting said table in said sloping relation toward said one edge of the frame;

means for reciprocatingly driving the table longitudinally of the frame along said track rods;

a vacuum plenum mounted on the lower portion of the table with an edge of the plenum along the lower edge of the table, the plenum having an array of perforations spaced about two inches on center in an upper supporting surface on which a glass plate to be beveled is placed with its edge to be beveled at the lower edge of the table for bevel grinding and polishing by means located along said longitudinal edge of the frame toward which the table slopes;

and a vacuum source separate from said table and plenum for effecting vacuum in said plenum to provide glass plate retaining suction through the perforations in said upper supporting surface and having a flexible conduit connection with said plenum to permit free reciprocating movement of the table relative to the vacuum source.

14. A machine according to claim 13, wherein said means for reciprocatingly driving the table comprises a rotary drive screw substantially coextensive with said track rods and located in parallel spaced relation between said track rods under said table, means carried by said frame at each end of the drive screw and rotatably supporting the drive screw, one of said means comprising a drive motor, and follower couplings on opposite ends of the table engaging said drive screw for driving of the table longitudinally along said track rods by rotation of said drive screw.

15. A machine according to claim 13, wherein said vacuum plenum is substantially as long as said table but of substantially less width and located along the lower edge of the table, said table having throughout the remainder of its width an array of button-like glass plate supporting members having limited contact glass plate supporting tops in a common plane with the upper supporting surface of the plenum.

16. A glass beveling machine, comprising:

bevel grinding and polishing means;

a table for supporting a glass plate to be beveled in generally face-up position and with an edge of the plate oriented for operation of said grinding and polishing means on said edge;

means enabling relative movement of the grinding and polishing means and the table in a beveling pass;

means for holding the glass plate on the table against displacement during the beveling pass;

said grinding and polishing means comprising respective wheels;

shafts carrying said wheels rotatably;

means for driving said shafts rotatably;

respective carriages carrying said shafts and said driving means;

rocker structure to which the carriages are attached;

means supporting said rocker structure;

means for adjusting the carriages in a generally up and down relation relative to said rocker structure;

means for adjusting the rocker structure tiltably relative to said rocker structure supporting means;

means for adjusting the position of said rocker structure supporting means in a generally horizontal direction toward and away from said table and said plate edge;

said table sloping toward said grinding and polishing wheels;

a vacuum plenum on the table adjacent to its lower edge and having a perforated surface supporting the lower edge portion of the glass plate in position for grinding and polishing by said wheels;

and gauging curb means along said plenum projecting to a height above said plenum surface less than the thickness of the glass plate for gauging the position of the plate along the edge of the table for grinding and polishing of a bevel by means of said wheels.

17. A machine according to claim 16, wherein the table includes glass supporting means upwardly thereon relative to said plenum and comprising an array of button-like limited glass contact members having their tops in a plane with said plenum surface, said table comprising an array of supporting bars in slat-like spaced relation, said bars carrying said button-like members.

* * * * *